US010196894B2

(12) United States Patent
Andrzejak et al.

(10) Patent No.: US 10,196,894 B2
(45) Date of Patent: Feb. 5, 2019

(54) COLLAPSE INITIATED EXPLOSIVE PELLET

(71) Applicant: Schlumberger Technology Corporation, Sugar Land, TX (US)

(72) Inventors: Timothy A. Andrzejak, Sugar Land, TX (US); Jorge E. Lopez de Cardenas, Sugar Land, TX (US); Robinson Egydio Lopes, Sao Paulo (BR)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 216 days.

(21) Appl. No.: 15/115,123

(22) PCT Filed: Jan. 28, 2015

(86) PCT No.: PCT/US2015/013261
§ 371 (c)(1),
(2) Date: Jul. 28, 2016

(87) PCT Pub. No.: WO2015/116662
PCT Pub. Date: Aug. 6, 2015

(65) Prior Publication Data

US 2016/0341035 A1 Nov. 24, 2016

Related U.S. Application Data

(60) Provisional application No. 61/932,561, filed on Jan. 28, 2014.

(51) Int. Cl.
*E21B 49/00* (2006.01)
*E21B 43/26* (2006.01)
(Continued)

(52) U.S. Cl.
CPC ..... *E21B 49/00* (2013.01); *E21B 43/26* (2013.01); *E21B 43/263* (2013.01); *F42B 1/00* (2013.01); *F42B 3/087* (2013.01); *F42B 3/117* (2013.01)

(58) Field of Classification Search
CPC ..... E21B 43/263
(Continued)

(56) References Cited

U.S. PATENT DOCUMENTS 2,708,876 A * 5/1955 Nowak ..... C09K 8/60 102/313
4,662,451 A 5/1987 Boade
(Continued)

FOREIGN PATENT DOCUMENTS

CN 202348247 7/2012
WO 2011154984 A2 12/2011

OTHER PUBLICATIONS

PCT/US2015/013261, International Search Report and Written Opinion, dated May 1, 2015, 12 pgs.
(Continued)

*Primary Examiner* — Walter L Lindsay, Jr.
*Assistant Examiner* — Philip Marcus T Fadul

(57) ABSTRACT

A technique facilitates analysis of hydraulic fractures. A plurality of explosive pellets is constructed for delivery into fracture or fractures of a subterranean formation. Each explosive pellet comprises an explosive material combined with an initiating member working in cooperation with a friction sensitive pyrotechnic mixture. Crushing or otherwise actuating the initiating member initiates the friction sensitive pyrotechnic mixture which, in turn, ignites the explosive material to produce explosive signals. The explosive signals may be monitored to obtain data related to the fracture or fractures.

17 Claims, 2 Drawing Sheets

(51) Int. Cl.

| | |
|---|---|
| ***E21B 43/263*** | (2006.01) |
| ***F42B 1/00*** | (2006.01) |
| ***F42B 3/087*** | (2006.01) |
| ***F42B 3/117*** | (2006.01) |

(58) Field of Classification Search
USPC ..... 73/35.14
See application file for complete search history.

(56) References Cited

U.S. PATENT DOCUMENTS

| | | | | |
|---|---|---|---|---|
| 7,134,492 | B2 * | 11/2006 | Willberg ..... | E21B 47/00 166/250.1 |
| 9,334,719 | B2 | 5/2016 | Rytlewski | |
| 2004/0226715 | A1 | 11/2004 | Willberg et al. | |
| 2013/0032337 | A1 * | 2/2013 | Rytlewski ..... | E21B 43/263 166/250.1 |

OTHER PUBLICATIONS

International Preliminary Report on Patentability issued in the related PCT Application PCT/US2015/013261, dated Aug. 2, 2016 (8 pages).

* cited by examiner

COLLAPSE INITIATED EXPLOSIVE PELLET

CROSS-REFERENCE TO RELATED APPLICATIONS

The present document is based on and claims priority to U.S. Provisional Application Ser. No.: 61/932,561, filed Jan. 28, 2014, which is incorporated herein by reference in its entirety.

BACKGROUND

Hydrocarbon fluids such as oil and natural gas are obtained from a subterranean geologic formation, referred to as a reservoir, by drilling a well that penetrates the hydrocarbon-bearing formation. In some applications, the hydrocarbon-bearing formation is fractured and the features of the hydraulic fractures may be characterized via hydraulic fracture monitoring. In some applications, hydraulic fracture monitoring is performed with an array of geophones used to map micro seismic events occurring in the reservoir rock during creation of fractures. However, the acoustic energy created by the rock when fractured is sometimes too small to detect or the acoustic energy is generated by adjacent portions of the rock rather than the fracture itself. As a result, inaccurate data may be generated.

SUMMARY

In general, a system and methodology are provided for analyzing hydraulic fractures. A plurality of explosive pellets is delivered into a fracture or fractures of a subterranean formation. Each explosive pellet comprises an explosive material combined with an initiating member working in cooperation with a friction sensitive pyrotechnic mixture. Crushing or otherwise actuating the initiating member ignites the friction sensitive pyrotechnic mixture which, in turn, ignites the explosive material to produce explosive signals. The explosive signals may be monitored to obtain data related to the fracture or fractures.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
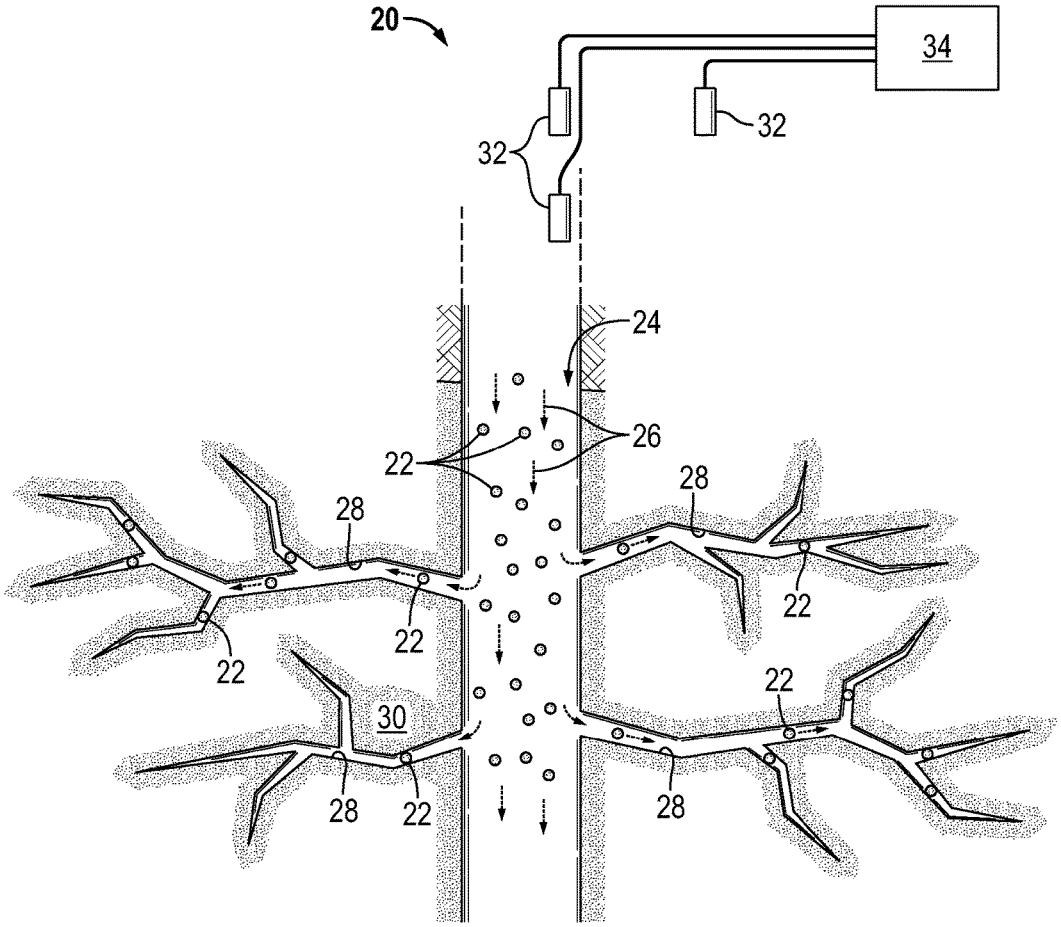
FIG. 1 is a schematic illustration of an example of a well system which may be employed to facilitate analysis of hydraulic fractures, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a system and methodology which facilitate analysis of hydraulic fractures. In some applications, a wellbore is drilled into a subterranean formation and the subterranean formation is fractured. A plurality of explosive pellets is delivered into a fracture or fractures of the subterranean formation by, for example, a delivery fluid. The delivery fluid may comprise fracturing slurry or another type of fluid able to carry the explosive pellets into the fracture or fractures extending into the surrounding subterranean formation.

Each explosive pellet comprises an explosive material combined with an initiating member working in cooperation with a friction sensitive pyrotechnic mixture. According to an embodiment, crushing of the initiating member initiates, e.g. ignites, the friction sensitive pyrotechnic mixture which, in turn, ignites the explosive material to produce explosive signals. The explosive signals may be monitored to obtain data related to the fracture or fractures. By way of example, geophones and/or other sensors may be coupled with a data processing system, e.g. a computer-based data processing system, to obtain fracture data via the explosive signals. The explosive pellets enable increased accuracy with respect to analysis of the fractures because the pellets may readily be introduced into the fractures without prematurely exploding. The pellets do not explode until experiencing a sufficient crushing load or other initiating input. Subsequently, the acoustic energy generated by the explosions may be monitored to enable accurate fracture analysis, e.g. accurate fracture mapping.

In an embodiment, the explosive pellets may be mixed with fracturing fluid and directed downhole into a wellbore and out into a fracture or fractures to improve the characterization of the hydraulic fractures. The explosive pellets effectively become a "talking proppant" via embedding of the explosive pellets in at least one hydraulic fracture and then initiating detonation of the explosive pellets to generate signals from within the at least one fracture. Sensors, e.g. geophones, may then be used to triangulate the explosive signals and to map the at least one hydraulic fracture. In this embodiment, the explosive pellets are constructed in the form of crush-initiated explosive pellets.

In some applications, the crush-initiated explosive pellets may utilize one or more frangible, e.g fracturable, members which break upon application of a sufficient crush load. The fracturable members may be in the form of a ring or rings which fracture when subjected to a sufficient compressive load. By way of example, the frangible members can comprise concentrically arranged, pre-stressed rings which are capable of initiating detonation of an explosive pellet when crushed. The concentric rings store potential energy as the pellet is deformed and upon failure, e.g. fracture, of the rings, kinetic energy is rapidly released to initiate a pyrotechnic composition formed of a desired mixture of materials. The pyrotechnic mixture burns at temperatures sufficiently high to initiate combustion of an adjacent explosive material. In some applications, the explosive material may comprise a primary explosive load adjacent the pyrotechnic mixture and a secondary explosive load. The primary explosive load is detonated by initiation of the pyrotechnic mixture and is able to rapidly transition from deflagration to detonation so as to detonate the adjacent secondary explosive load.

The frangible member or members may be formed from a variety of materials which fracture when subjected to a sufficient load so as to rapidly release energy. For example, some embodiments may utilize a frangible member or members formed of a strong, brittle material which stores energy while the explosive pellet is slowly collapsed under sufficient compressive loading. When the brittle material fails, e.g. fractures, kinetic energy is rapidly released and the pyrotechnic mixture is initiated. An example of a strong, brittle material which can be used to initiate the pyrotechnic mixture is heat-treated tool steel although a variety of other materials and combinations of materials may be utilized.

Referring generally to FIG. 1, an example of a system 20 for facilitating analysis of hydraulic fractures is illustrated. In this embodiment, system 20 comprises a plurality of explosive pellets 22 which may be flowed downhole into a borehole 24 via a suitable carrier fluid 26, e.g. fracturing fluid. The flowing carrier fluid 26 carries the explosive pellets 22 out into at least one fracture 28 and often into a plurality of fractures 28 formed in a surrounding geologic formation 30. In various applications, the explosive pellets 22 may be carried into fractures 28 during a fracturing procedure. Thus, once the fracturing pressure is relaxed, the fractures tend to contract and place compressive loads on the explosive pellets 22 which have become trapped in the fracture or fractures 28. As described in greater detail below, the compressive loads cause the explosive pellets 22 to explode and to thus generate explosive signals, e.g. acoustic signals, from within the corresponding fracture 28.

A plurality of sensors 32, e.g. geophones, is deployed (e.g. deployed in the same well, in a neighboring well, or on the surface around the well being stimulated) in a desired pattern to detect the explosive signals. The sensors 32, e.g. geophones, may be used to triangulate the explosive signals and to thus map the hydraulic fracture with the aid of a suitable processing system 34. As illustrated, the sensors 32 may be communicatively coupled with processing system 34 which collects and processes data obtained by the various sensors 32. By way of example, the processing system 34 may comprise a computer-based processing system having one or more microprocessors or other suitable processors able to analyze the explosive signal data. The sensors 32 may be coupled with processing system 34 wirelessly or via physical communication lines.

Figure 2:
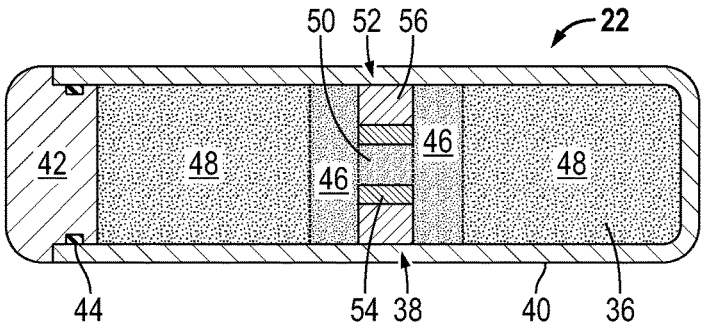
FIG. 2 is an illustration of an example of an explosive pellet, according to an embodiment of the disclosure.

Referring generally to FIG. 2, an example of one of the explosive pellets 22 is illustrated. In this embodiment, the explosive pellet 22 comprises an explosive material 36 and an initiating member 38. The explosive material 36 and the initiating member 38 may be disposed within a casing 40 which, in some applications, may be capped with at least one sealing cap 42 having a seal 44, e.g. O-ring. By way of example, casing 40 may be formed of a metal material, e.g. aluminum, or of other suitable materials.

The explosive material 36 may be formed from a variety of materials arranged in desired configurations. In the embodiment illustrated, the explosive material 36 comprises a primary explosive material 46 and a main or secondary explosive material 48. The primary explosive material 46 is disposed adjacent the initiating member 38 and the secondary explosive material 48 is disposed adjacent the primary explosive material 46. Thus, the primary explosive material 46 is detonated by initiation, e.g. detonation or ignition, of the initiating member 38, and then the primary explosive material 46 is able to detonate the adjacent secondary explosive material 48 to create the explosive signals from within the corresponding fracture 28.

Similarly, the initiating member 38 may be formed from a variety of materials and in several configurations. In the embodiment illustrated, the initiating member 38 comprises a pyrotechnic mixture 50, e.g. a friction sensitive pyrotechnic mixture. In some embodiments, however, a primary explosive material may be used as pyrotechnic mixture 50 instead of, for example, a friction sensitive pyrotechnic mixture. The pyrotechnic mixture 50 is disposed within a frangible member 52, e.g. a fracturable member. The member 52 is formed of a suitable material and constructed to fracture upon application of a sufficient crush load. The sufficient crush load may result from contraction of the corresponding fracture 28. In some applications, the initiating member 38 may be initiated via other types of forces or mechanisms, e.g. electrical or hydraulic actuators.

In some embodiments, the fracturable member 52 may be in the form of a ring 54 disposed adjacent to, e.g. encircling, the pyrotechnic mixture 50. In this example, the pyrotechnic mixture 50 is a friction-sensitive pyrotechnic mixture which is initiated, e.g. ignited, by the release of energy upon fracture of the member 52, e.g. ring 54. The frangible member 52 also may comprise a plurality of members, such as ring 54 and a cooperating ring 56. In the illustrated example, rings 54, 56 are concentric rings disposed adjacent to, e.g. encircling, the pyrotechnic mixture 50. In this latter example, the rings 54, 56 similarly fracture when subjected to a sufficient compressive load.

By way of example, the rings 54, 56 may be pre-stressed rings which are concentrically positioned and able to initiate detonation of the overall explosive pellet 22 when crushed. The concentric rings 54, 56 store potential energy during deformation of the pellet 22. Upon failure, e.g. fracture, of the rings 54, 56, kinetic energy is rapidly released to ignite the pyrotechnic mixture 50 which, in turn, initiates the primary explosive 46 and thus secondary explosive 48. As illustrated, the pyrotechnic mix 50 may be located within the smaller of the two concentric rings 54, 56. Additionally, the primary explosive material 46 may be positioned adjacent pyrotechnic mix 50, and the secondary explosive material 48 may be positioned adjacent primary explosive material 46.

Figure 3:
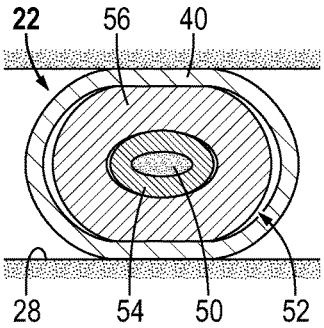
FIG. 3 is an illustration of an example of an initial stage of crushing an explosive pellet, according to an embodiment of the disclosure.
Figure 4:
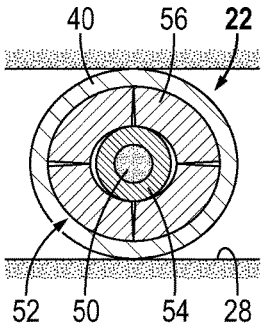
FIG. 4 is an illustration similar to that of FIG. 3 but showing a subsequent stage in which a portion of the explosive pellet is undergoing fracture, according to an embodiment of the disclosure.
Figure 5:
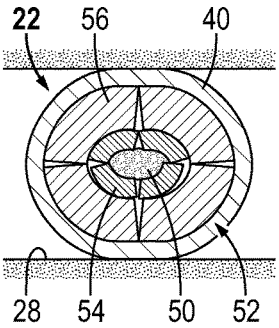
FIG. 5 is an illustration similar to that of FIG. 4 but showing a later stage in which the explosive pellet has been further fractured to initiate detonation of a pyrotechnic material, according to an embodiment of the disclosure.

Referring generally to FIGS. 3-5, an operational example is illustrated in which the two concentric rings 54, 56 are used to initiate the pyrotechnic mixture 50. In this example, the outer ring 56 is subjected to a crushing load via compression of casing 40 upon a closure movement of a corresponding formation fracture 28, as illustrated in FIG. 3. As the concentric rings 54, 56 are stressed under the compressive load, the outer ring 56 is initially fractured, e.g. fractured into quadrants, as illustrated in FIG. 4. As deformation of the explosive pellet 22 continues, the quadrants or pieces of the outer ring 56 pinch down on the smaller, inner ring 54 until it fails and fractures, as illustrated in FIG. 5. The pyrotechnic mixture 50 is sufficiently confined such that the release of energy from fracture of the inner ring 54 initiates the pyrotechnic mixture 50.

Figure 6:
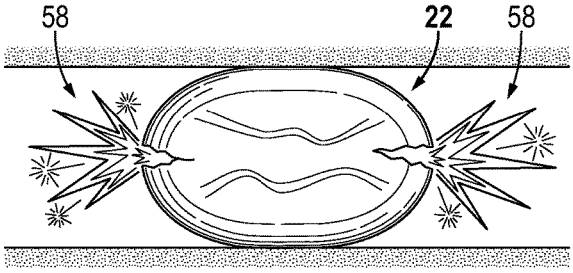
FIG. 6 is an illustration of an example of initiation of the pyrotechnic material, according to an embodiment of the disclosure.
Figure 7:
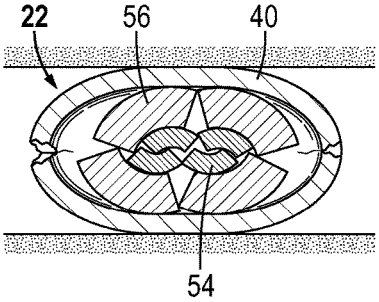
FIG. 7 is a cross-sectional illustration of an example of the explosive pellet following detonation of the explosive material, according to an embodiment of the disclosure.

As illustrated in FIG. 6, initiation of the pyrotechnic mixture 50, due to the collapse of frangible member 52, causes the primary explosive material 46 to ignite. The energy resulting from the ignition of primary explosive material 46 causes ignition and explosion of the secondary explosive material 48 to effectively explode the corresponding pellet 22 as represented by the graphical explosion 58 in FIG. 6. The explosion effectively sends out an explosive/acoustic signal from that location along the corresponding formation fracture 28; and data, e.g. position data, may be detected by sensors 32 and analyzed by processing system 34. Data from a plurality of exploding pellets 22 provide substantial information on the fractures 28, e.g. location, direction, and/or orientation, which is useful in characterizing the features of a fracture network resulting from a fracturing operation on subterranean formation 30. Following the explosion, the rings 54, 56 and the overall explosive pellet 22 remain in a collapsed state, as illustrated in FIG. 7.

A variety of pyrotechnic mixtures 50 can be used to initiate the explosions of individual pellets 22. However, an example of a suitable pyrotechnic mixture is a friction-sensitive mixture comprising a fuel, an oxidizer, and a friction additive. A specific embodiment comprises zirconium (a fuel), potassium perchlorate (an oxidizer), and glass pieces (a friction additive) although other materials may be utilized. The pyrotechnic mixture 50 also may comprise a portion of the primary explosive material 46 or may be formed separately of the same or similar material.

Examples of suitable materials for the pyrotechnic mixture 50 and/or primary explosive material 46 comprise lead azide, lead styphnate, silver azide, mixtures of these components, and/or other suitable components. Additionally, examples of suitable materials for the main/secondary explosive material 48 comprise pentaerythritol tetranitrate (PETN), RDX, HMX, hexanitrostilbene (HNS), mixtures of these components, and/or other suitable components.

Depending on the specific application, the overall system 20 may have a variety of components and configurations. For example, the system 20 may comprise numerous types of geophones and/or other sensors 32 for use in a variety of well environments or other subterranean environments. Additionally, various types of data processing systems 34 may be employed to process acoustic data and/or other types of data resulting from signals created upon explosion of various pellets 22 deployed in one or more formation fractures 28. The size, shape and number of explosive pellets 22 deployed for a given operation also may vary, and the mechanism, e.g. fluid, for deploying the explosive pellets 22 into the desired fracture 28 may be selected according to the parameters of the given operation.

Similarly, the individual pellets 22 may comprise various other and/or additional components. For example, the individual pellets 22 be formed with various casing components having a variety of configurations. Similarly, the explosive material may be positioned at single or plural locations within the casing 40. The explosive material 36 and the pyrotechnic mixture 50 may be formed from a variety of suitable materials used alone or in combination.

The initiating member 38 also may be positioned at selected locations within the casing 40 and may be constructed in a variety of suitable configurations. The frangible member 52 may comprise a single member or plural members formed of a material able to store energy during flexing while being sufficiently brittle to fracture and release the energy for initiation of the pyrotechnic mixture 50. The frangible member 52 may be in the form of a ring, a plurality of rings, or other suitable structures able to fracture under a sufficient compressive load.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for analyzing hydraulic fractures, comprising:
an explosive pellet having:
a casing;
a primary explosive material disposed within the casing;
a secondary explosive material disposed within the casing adjacent to the primary explosive material;
an initiating member; wherein the initiating member comprising a set of concentric rings; and
a friction sensitive pyrotechnic mixture disposed inside the initiating member, the friction sensitive pyrotechnic mixture being positioned adjacent the primary explosive material.

2. The system as recited in claim 1, wherein at least one of the concentric rings comprises a brittle material able to fracture under a crushing load.

3. The system as recited in claim 1, wherein the friction sensitive pyrotechnic mixture is disposed within an interior concentric ring.

4. The system as recited in claim 1, wherein the friction sensitive pyrotechnic mixture comprises a portion of the primary explosive material.

5. The system as recited in claim 1, wherein the friction sensitive pyrotechnic mixture comprises at least one of lead azide, lead styphnate, or silver azide.

6. The system as recited in claim 1, wherein the friction sensitive pyrotechnic mixture comprises a fuel, an oxidizer, and a friction additive.

7. The system as recited in claim 1, wherein the friction sensitive pyrotechnic mixture comprises zirconium, potassium perchlorate, and glass pieces.

8. A method to facilitate analysis of hydraulic fractures, comprising:
forming a plurality of explosive pellets with each explosive pellet having an explosive material within a casing and an initiating member comprising a friction sensitive pyrotechnic mixture within a plurality of fracturable rings;
delivering the plurality of explosive pellets into at least one fracture extending into a subterranean formation; and
monitoring the explosive signals provided upon detonation of the explosive material via crushing of explosive pellets of the plurality of explosive pellets.

9. The method as recited in claim 8, wherein forming comprises forming the explosive material with a primary explosive material and a secondary explosive material.

10. The method as recited in claim 8, wherein forming comprises placing the friction sensitive pyrotechnic mixture within a fracturable member.

11. The method as recited in claim 8, wherein forming comprises placing the friction sensitive pyrotechnic mixture within a fracturable ring.

12. The method as recited in claim 8, wherein delivering comprises flowing the plurality of explosive pellets downhole via a fluid.

13. The method as recited in claim 8, wherein monitoring comprises triangulating the explosive signals via a plurality of geophones.

14. The method as recited in claim 8, further comprising using data obtained during monitoring to characterize a plurality of hydraulic fractures.

15. A system, comprising:

a liquid; and a plurality of explosive pellets disposed in the liquid, each explosive pellet having an explosive material and initiating member to ignite the explosive material upon fracture of at least a portion of the initiating member, wherein the initiating member comprises a plurality of fracturable rings.

16. The system as recited in claim 15, wherein at least one of the plurality of fracturable rings is a frangible ring having a pyrotechnic material disposed within the frangible ring.

17. The system as recited in claim 15, wherein each explosive pellet comprises a casing around the explosive material and the initiating member.

* * * * *